US008421744B2

(12) United States Patent
Koyama et al.

(10) Patent No.: US 8,421,744 B2
(45) Date of Patent: Apr. 16, 2013

(54) INFORMATION DISPLAY HAVING SEPARATE AND DETACHABLE UNITS

(75) Inventors: Fumio Koyama, Hara-mura (JP); Yoshiyuki Kodama, Chino (JP); Dai Tanaka, Shiojiri (JP)

(73) Assignee: Seiko Epson Corporation (JP)

( * ) Notice: Subject to any disclaimer, the term of this patent is extended or adjusted under 35 U.S.C. 154(b) by 430 days.

(21) Appl. No.: 12/420,303

(22) Filed: Apr. 8, 2009

(65) Prior Publication Data

US 2009/0195496 A1 Aug. 6, 2009

Related U.S. Application Data

(63) Continuation of application No. 11/014,623, filed on Dec. 16, 2004, now abandoned.

(30) Foreign Application Priority Data

Dec. 16, 2003 (JP) ..... 2003-418404

(51) Int. Cl.
*G09G 3/34* (2006.01)

(52) U.S. Cl.
USPC ..... 345/107

(58) Field of Classification Search ..... 345/107, 345/204; 178/18.07, 19.03
See application file for complete search history.

(56) References Cited

U.S. PATENT DOCUMENTS

| | | | | |
|---|---|---|---|---|
| 3,757,311 | A | 9/1973 | Byram et al. | |
| 3,978,470 | A | 8/1976 | McGuire | |
| 4,706,213 | A | 11/1987 | Bandai | |
| 5,057,244 | A | 10/1991 | Nitta et al. | |
| 5,392,058 | A | 2/1995 | Tagawa | |
| 5,581,274 | A | 12/1996 | Tagawa | |
| 5,835,721 | A * | 11/1998 | Donahue et al. | 709/224 |
| 6,002,387 | A | 12/1999 | Ronkka et al. | |
| 6,799,226 | B1 * | 9/2004 | Robbin et al. | 710/15 |
| 6,831,771 | B2 | 12/2004 | Ho et al. | |
| 6,906,705 | B2 | 6/2005 | Matsuo et al. | |
| 2002/0010600 | A1 | 1/2002 | Fujita | |
| 2002/0055938 | A1 | 5/2002 | Matsuo et al. | |
| 2002/0105600 | A1 | 8/2002 | Shimoda et al. | |
| 2003/0020701 | A1 | 1/2003 | Nakamura et al. | |
| 2003/0024994 | A1 | 2/2003 | Ladyansky | |
| 2004/0193942 | A1 * | 9/2004 | Barr et al. | 714/4 |

FOREIGN PATENT DOCUMENTS

| | | |
|---|---|---|
| EP | 1276090 | 2/2003 |
| JP | 02-047771 | 2/1990 |
| JP | 04-001798 | 1/1992 |
| JP | 05-035223 | 2/1993 |
| JP | 06-274129 | 9/1994 |
| JP | 09-319558 | 12/1997 |
| JP | 2000-315127 | 11/2000 |
| JP | 2001-066999 | 3/2001 |

(Continued)

*Primary Examiner* — Sumati Lefkowitz
*Assistant Examiner* — Robert E Carter, III
(74) *Attorney, Agent, or Firm* — Harness, Dickey & Pierce, P.L.C.

(57) ABSTRACT

An information display has an information carrier including a storable display panel separate from a processing unit including a battery, and where there is a need to perform a process such as updating or manipulating information displayed on the display panel, it is possible to perform a desired process by connecting the processing unit to the information carrier.

6 Claims, 9 Drawing Sheets

FOREIGN PATENT DOCUMENTS

| | | |
|---|---|---|
| JP | 2002-169190 | 6/2002 |
| JP | 2002-287690 | 10/2002 |
| JP | 2003-216111 | 7/2003 |
| JP | 2003-296008 | 10/2003 |

* cited by examiner

INFORMATION DISPLAY HAVING SEPARATE AND DETACHABLE UNITS

This application is a continuation of U.S. patent application Ser. No. 11/014,623 filed on Dec. 16, 2004. This application claims the benefit of Japanese Patent Application No. 2003-418404 filed Dec. 16, 2003. The disclosures of the above applications are incorporated herein by reference.

BACKGROUND OF THE INVENTION

1. Field of the Invention

The present invention relates to an information display for displaying information which is a display object.

2. Description of the Related Art

It is common practice to print information on "paper" as a method of visibly representing the information.

Printing information on paper (a so-called hard copy) has been used and improved for ages so that excellent printing technology is now well established.

However, hard-copied information is firmly fixed on paper, and it is difficult to rewrite, erase or use such information as electronic information.

As regards the display of general display information provided to a PC (Personal Computer) and so on (a so-called soft copy), a display element is becoming increasingly lower-profile. Further, high definition and high contrast are now realized in terms of display performance. In particular, a light and thin display medium called "electronic paper" is under development lately, which can hold natural display with no electricity by a reflection method based on a new display principle. It is anticipated that electronic paper will be capable of realizing a display quality close to a hard copy. For instance, JP2002-169190A discloses a technique relating to such a display medium called electronic paper.

As for information displays including such electronic paper as the display medium, there are various proposals of using the electronic paper instead of conventional display media (nematic liquid crystal for instance) for information displays such as a PDA (Personal Data Assistant).

An information display including electronic paper as the display medium can realize reusability of the information by exploiting characteristics of the soft copy while realizing a conventional display quality close to "paper." Therefore, it is anticipated that this technology will have high utility value for replacing paper.

However, an information display merely having a display medium of a conventional information display replaced by electronic paper can hardly realize usability and viewability comparable to "paper" or a book comprised of the paper.

To be more specific, it is difficult to realize free use conditions like paper just by extending the idea of a conventional information display because electronic paper has a processing portion for processing and displaying the information and a power supply for driving the electronic paper.

The information display becomes expensive since it has both a processing portion and a power supply and therefore it is difficult for a user to possess multiple information displays. For that reason, it is difficult to refer to multiple display media at the same time as you can do easily with paper.

Furthermore, printing the information on paper allows the user to grasp the information. However, a conventional information display that switches screens cannot be used by a user as if it is "paper." To be more specific, in the case of displaying information on a conventional information display, the displayed information easily disappears. Therefore, it is not possible to render the information as a corporeal thing and thereby handle it in a sensuously reliable form with a sense of security as in the case of printing on paper.

Thus, it is difficult to use electronic paper instead of paper by merely replacing the display medium portion of a conventional information display with electronic paper.

Therefore, an object of the present invention is to realize a convenient information display to replace paper.

To be more precise, an object is to realize an information display capable of handling information in a free usage pattern as with paper and in a reassuring form as with paper at a relatively low cost.

SUMMARY OF THE INVENTION

An information display according to the present invention includes a display section (a display panel 14 in FIG. 2 for instance) keeping a display state nonvolatile wherein the display section is comprised of a unit (an information carrier 10 in FIG. 2 for instance) separate and detachable from at least one nondisplay unit (a processing unit 20 in FIG. 2 for instance) having a predetermined function other than the function of keeping display contents nonvolatile, and the units are capable of mutually cooperative operation.

With such a configuration, it is possible, in normal use, to separate from the information display those components other than the ones for maintaining "display" which is a fundamental for a display close to "paper."

Thus, it is possible to render a light-armed apparatus while combining good display quality close to "paper" with reusable information (the function of handling displayed information as electronic data) so as to significantly improve operability in comparison with a conventional information display.

To be capable of mutually cooperative operation, the apparatus is configured to be capable of communication, information processing by mutually sending and receiving the information, and supplying power from one unit to the other unit.

In such a configuration, it is also possible to store display data in a format to be displayed on the display section (data in an intermediate format or rasterized data in a preferred embodiment of the invention) generated from the data as a display object (document data in the preferred embodiment of the invention) in a memory provided on a nondisplay unit side.

Thus, it is no longer necessary to store the display data in the unit comprising the display section, and so it is possible to reduce costs.

Furthermore, it is also possible to provide a power supply for supplying the power to rewrite the display contents to the unit comprising the display section.

The information display according to the present invention may also include a display section comprised of a storable display capable of keeping a display state without supplying power (for instance, an electrophoretic display, a cholesteric liquid crystal display, a display using a charged toner, a display using a twist ball or an electro-deposition display).

With such a configuration, it is possible to keep the display state nonvolatile on the display so as to easily render the display section as an independent unit. It is also possible to render the unit comprising the display section lighter-armed.

The display section may include a non-storable display requiring power to keep the display state and a display having the power supply for supplying the power to keep the display state.

With such a configuration, it is possible to simply realize a pseudo storable display by using the non-storable display.

The nondisplay unit is a unit having a display processing function of generating the display data in the form to be displayed as the display object on the display section from the data and the function of supplying the power for rewriting the display contents on the display section (processing units 20, 20*a* and 20*b* in FIGS. 1, 7 and 9 for instance).

In the case of such a configuration, the information display can have its main functions comprised of two units.

The nondisplay unit may also be a unit having a display processing function of generating the display data in the form to be displayed on the display section (processing unit 20 in FIG. 6 for instance) from the data as the display object and a unit having the function of supplying the power for rewriting the display contents on the display section (power supply unit 30 in FIG. 6 for instance).

In the case of such a configuration, the information display can have its main functions comprised of three units.

A storage section is also provided for holding the data as the nonvolatile display object on the unit comprising the display section.

With such a configuration, it is possible to have the displayed information and its location as one so as to render the unit comprising the display section as the medium for handling the information as a corporeal thing as with "paper."

The storage section also keeps the display data in the form to be displayed on the display section generated from the data as the nonvolatile display object on the unit comprising the display section.

With such a configuration, it is possible to perform a continuous process so as to alleviate a processing load of the nondisplay unit, even in the case of handling the unit comprising the display section with a different nondisplay unit.

At least one of the unit comprising the display section and the nondisplay unit is configured to be sharable by the nondisplay unit or the unit comprising the display section of another information display.

With such a configuration, it is possible to broadly utilize the unit comprising the display section.

For instance, it is possible to have the information stored in the unit comprising the display section processed sequentially by multiple users with the nondisplay units belonging to them respectively so as to process the information as intended.

It is also possible, by having such a configuration, to have the process performed to multiple units comprising the display section by one nondisplay unit.

The unit comprising the display section has an instruction input section for inputting an instruction to the information display by a predetermined input operation, and the nondisplay unit becomes an operating instrument for performing the predetermined input operation.

For instance, it is possible to have a configuration in which the instruction input section is a button for detecting contact of the nondisplay unit, and the nondisplay unit is a pen-shaped operating instrument so as to have an instruction inputted only by the nondisplay unit.

DESCRIPTION OF THE PREFERRED EMBODIMENT

Figure 1:
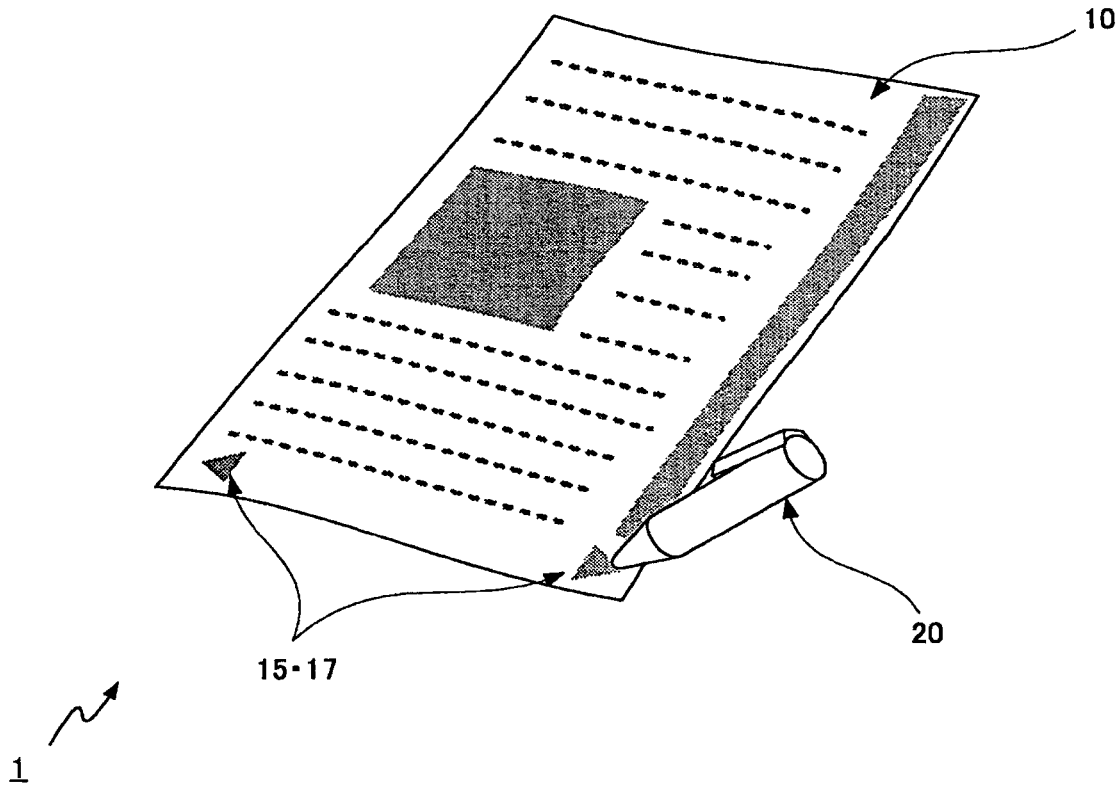
FIG. 1 is a diagram showing an external view of an information display according to the present invention.

Hereunder, embodiments of an information display according to the present invention will be described by referring to the drawings.

First Embodiment

Figure 2:
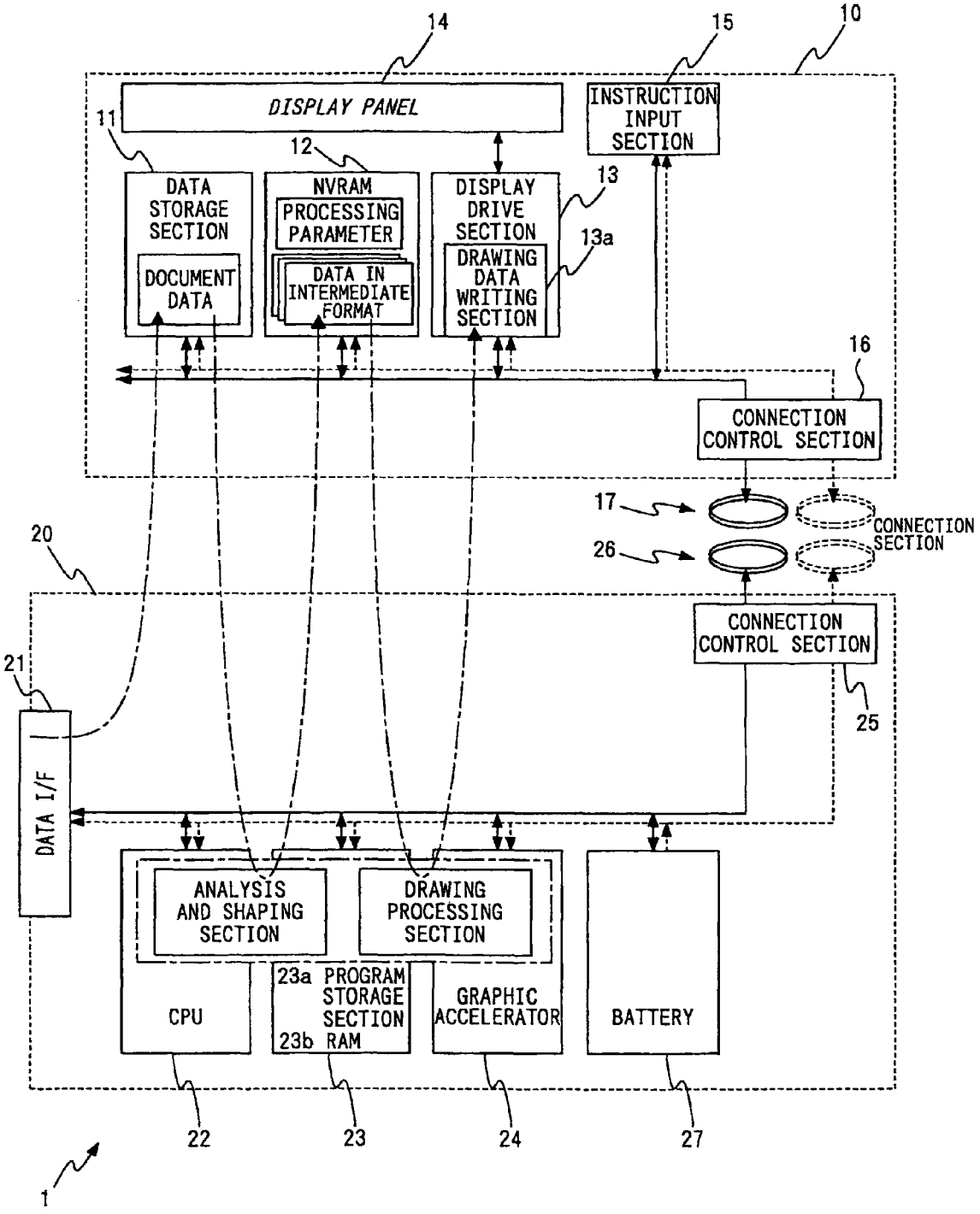
FIG. 2 is a block diagram showing a functional configuration of the information display.

FIG. 1 is a diagram showing an external view of an information display 1 according to a first embodiment of the present invention, and FIG. 2 is a block diagram showing a functional configuration of the information display 1.

In FIGS. 1 and 2, the information display 1 is comprised of an information carrier 10 in a light and thin form like paper and a pen-shaped processing unit 20.

The information carrier 10 is comprised of a data storage section 11, an NVRAM (Non-Volatile Random Access Memory) 12, a display drive section 13, a display panel 14, an instruction input section 15, a connection control section 16 and a connection section 17, which are connected by a bus 18 to be capable of communication.

The data storage section 11 is comprised of a nonvolatile memory such as a flash memory, and is capable of storing data inputted from a data interface (hereafter, referred to as a "data I/F") 21 via the connection section 17 described later.

The NVRAM 12 is comprised of a memory such as a FeRAM/FRAM (Ferroelectric Random Access Memory) or an MRAM (Magnetoresistive Random Access Memory), and forms a work area when a CPU 22 performs a process and also stores a processing result thereof.

The display drive section 13 directly controls the display panel 14 to have drawing data inputted from a graphic accelerator (hereafter, referred to as a "GA") 24 described later displayed on the display panel 14.

To be more precise, the display drive section 13 has a drawing data writing section 13*a* to which the drawing data is inputted by the GA 24. The display drive section 13 refers to the drawing data inputted to the drawing data writing section 13*a* and drives an X driver and a Y driver of the display panel 14 so as to have a raster figure as a drawing object displayed on the display panel 14.

As for a system for driving the display panel 14, it is possible to adopt a passive matrix drive system, a TFT (Thin Film Transistor) system, a TFD (Thin Film Diode) system or a D-TFD (Digital Thin Film Diode) system for instance.

The display panel 14 is comprised of a display of high pixel density (multi-pixel) of A4 size, and displays pixel data on predetermined pixels according to control of the display drive section 13.

A storable display (a display having its display screen maintained even after turning off the power) is used as the display panel 14. Therefore, no power is required to maintain a state of the display screen, and so it is possible to render the information display 1 less power-consuming.

As for the display panel 14, it is possible to adopt an electrophoretic display, a cholesteric liquid crystal display, a display using a charged toner, a display using a twist ball or an electro-deposition display.

The instruction input section 15 has a predetermined user interface and accepts an instruction input by a user. The instruction input section 15 may be a mechanical interface such as a push button or an electromagnetic interface also having the function of the connection section 17 described later (refer to FIG. 3).

The connection control section 16 controls the input and output of information and power performed via the connection section 17.

To be more specific, the connection control section 16 converts parallel data inputted from the display drive section 13 or the instruction input section 15 to serial data to output it to the connection section 17, and also converts the serial data inputted from the connection section 17 to the parallel data to output it to the data storage section 11, NVRAM 12, display drive section 13 or instruction input section 15. As the connection control section 16 performs such a process and a connection control section 25 on the processing unit 20 performs the same process as will be described later, the information sent and received between the bus 18 and a bus 28 of the processing unit 20 is bidirectionally serial-converted so as to put the bus 18 and the bus 28 of the processing unit 20 in a state of an inter-bus connection.

The connection control section 16 detects supply of the power from the processing unit 20 via the connection section 17, and rectifies AC power inputted via the connection section 17 to output it to the data storage section 11, NVRAM 12, display drive section 13 or instruction input section 15.

The connection section 17 is the interface for inputting and outputting the information and power between the information carrier 10 and the processing unit 20. To be more precise, the connection section 17 has a coil for inputting and outputting the information and a coil for inputting and outputting the power, and connects them electromagnetically to two coils provided likewise to a connection section 26 of the processing unit 20 respectively so as to input and output the information and power. It is possible, between the connection section 17 and the connection section 26, to input and output the information and power simultaneously with the above-mentioned coils or input and output them by switching between them by time division in order to securely prevent mutual interference on conveying the information and power.

It is possible, by providing the connection sections 17 corresponding to different instruction input contents respectively, to have a configuration in which the connection sections 17 also have the function of the instruction input section 15 comprised of the electromagnetic user interface.

Figure 3:
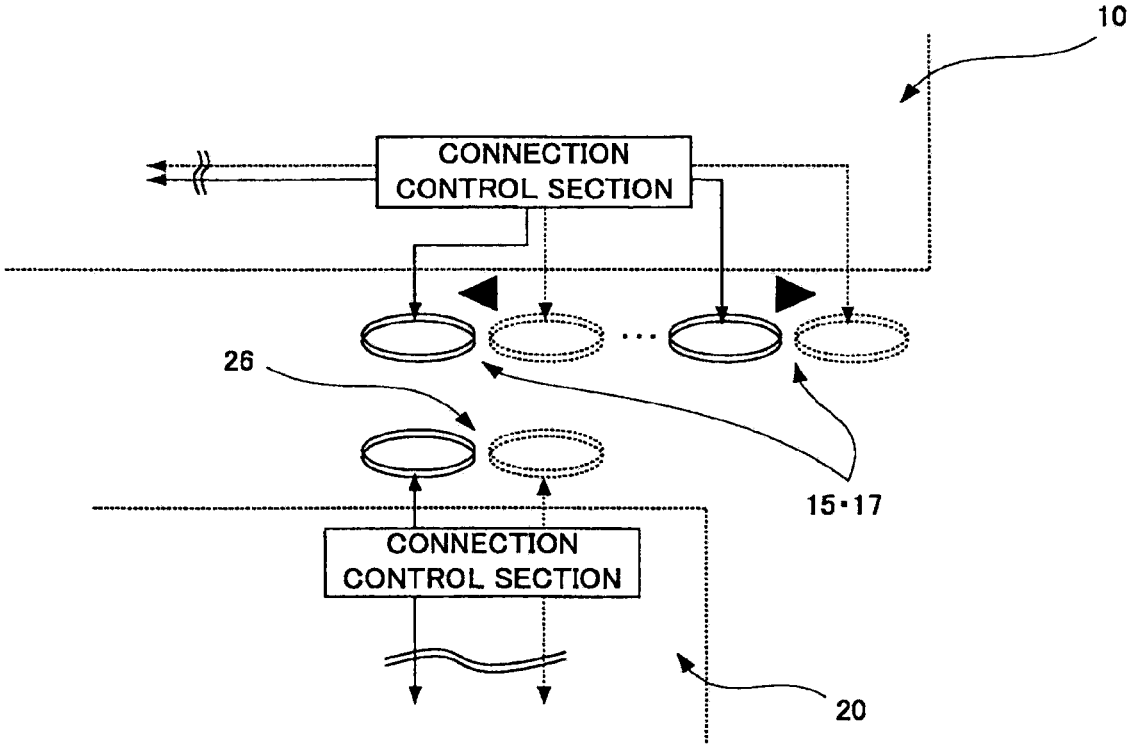
FIG. 3 is a diagram showing an example in which a connection section also has a function of an instruction input section comprised of an electromagnetic user interface.

FIG. 3 is a diagram showing an example in which the connection section 17 also has the function of the instruction input section 15 comprised of the electromagnetic user interface.

In FIG. 3, the connection section 17 on the left side has the function of the instruction input section 15 corresponding to a page-turning button in FIG. 2. If the processing unit 20 is connected to the connection section 17 on the left side, the power is supplied and the information is inputted and outputted, and the instruction to turn the page is also inputted. Likewise, the connection section 17 on the right side has the function of the instruction input section 15 corresponding to a page-turning-back button in FIG. 2. If the processing unit 20 is connected to the connection section 17 on the right side, the power is supplied and the information is inputted and outputted, and the instruction to turn back the page is also inputted.

In FIG. 3, a description was given as to an example in which the connection section 17 is provided at a position corresponding to each button. It is also possible, however, to provide the connection section 17 like a matrix all over the information carrier 10. It becomes possible, with such a configuration, to grasp the position on the information carrier 10 to which the processing unit 20 is connected so as to allow various processes such as selecting a displayed document.

Next, the processing unit 20 is comprised of the data I/F 21, CPU 22, storage section 23, GA 24, connection control section 25, connection section 26 and a battery 27, which are connected by the bus 28 to be capable of communication.

The data I/F 21 is an interface that is capable of inputting the data from outside the processing unit 20, and is comprised of a communication interface or a slot of a storage medium for instance. The data inputted via the data I/F 21 is outputted from the connection section 26 to the information carrier 10, and is stored in the data storage section 11 of the information carrier 10.

The CPU 22 controls the entire information display 1, and reads and executes programs relating to various processes stored in a program storage section 23*a* of the storage section 23 according to various instruction signals inputted from the instruction input section 15. The CPU 22 performs the process for displaying content data stored in the data storage section 11 or the storage medium inserted into the data I/F 21 on the display panel 14. The CPU 22 stores various processing results in an RAM 23*b* of the storage section 23.

The storage section 23 has the program storage section 23*a* comprised of a nonvolatile memory such as a flash memory, which has various programs for controlling the information display 1 stored therein.

The storage section 23 also has the RAM 23*b* comprised of a volatile memory such as a DRAM (Dynamic Random Access Memory) or an SRAM (Static Random Access Memory), which can temporarily hold various data generated when the CPU 22 performs the process. As for the RAM 23*b*, the SRAM capable of holding the data at low power consumption is desirable, and the nonvolatile FeRAM/FRAM or MRAM is more desirable.

The GA 24 is hardware capable of performing a drawing process of an image to be displayed on the display panel 14 at high speed according to an order of the CPU 22. To be more precise, the GA 24 performs a process such as developing a vector figure inputted from the CPU 22 into a raster figure. The GA 24 outputs the drawing data for drawing a figure having undergone the drawing process on the display panel 14 to the display drive section 13.

The connection control section 25 controls the input and output of the information and power performed via the connection section 26. To be more specific, the connection control section 25 converts the parallel data inputted from the CPU 22, storage section 23, GA 24 or battery 27 to serial data to output it to the connection section 26, and also converts the serial data inputted from the connection section 26 to the parallel data to output it to the CPU 22, storage section 23, GA 24 or battery 27. The connection control section 25 also renders DC power inputted from the battery 27 as AC to output it to the connection section 26.

The connection section 26 is the interface for inputting and outputting the information and power between the information carrier 10 and the processing unit 20. To be more specific, the connection section 26 has a coil for inputting and outputting the information and a coil for inputting and outputting the power, and connects them electromagnetically to the two coils provided likewise to the connection section 17 of the information carrier 10 respectively so as to input and output the information and power.

The battery 27 is comprised of a primary battery or a secondary battery, and supplies the power to the sections of the information display 1.

Under the above-mentioned configuration, it is possible to realize an analysis and shaping section 110 and a drawing processing section 120 shown in FIG. 2 by having a predetermined program executed by the information display 1.

The analysis and shaping section 110 converts document data stored in the data storage section 11 to an intermediate format. To be more precise, it breaks down the document data into drawing elements and describes it in a form displayable at high speed (intermediate format).

The drawing processing section 120 performs the drawing process for displaying the data converted to the intermediate format by the analysis and shaping section 110 on the display panel 14. For instance, the drawing processing section 120 performs the process for rasterizing the drawing elements included in the intermediate format.

Next, an operation of the above will be described.

The information display 1 according to the present invention has the connection section 17 of the information carrier 10 and the connection section 26 of the processing unit 20 electromagnetically connected so as to supply the power from the processing unit 20 to the information carrier 10 and allow the input and output of the information. Thus, the entire information display 1 becomes operable.

If the document data is inputted via the data I/F 21 of the processing unit 20, the document data is stored in the data storage section 11 of the information carrier 10. In the case where the data I/F 21 is a slot of the storage medium, it is also possible to read and use the data directly from the storage medium inserted into the slot without storing it in the data storage section 11.

Then, the analysis and shaping section 110 configured on the processing unit 20 starts processing the document data. To be more specific, the analysis and shaping section 110 interprets the document structure of the document data, and performs a layout process for screen display according to that structure. The analysis and shaping section 110 stores the document data having undergone the layout process in the NVRAM 12 as the data in the intermediate format.

In this case, the NVRAM 12 of the information carrier 10 is also used as a static data area (an area for storing the data representing the state of processing such as a page number currently in process).

Next, the drawing processing section 120 generates the drawing data from the data in the intermediate format stored in the NVRAM 12, and writes it to the drawing data writing section 13*a* of the display drive section 13.

Then, the display drive section 13 drives the display panel 14 according to the drawing data written to the drawing data writing section 13*a* so that a document is displayed on the display panel 14.

If the processing unit 20 is separated from the connection section 17, no power is supplied to the information carrier 10 so that the operation of the sections comes to a stop.

As the display panel 14 is storable, however, the display state is continuously maintained even after the supply of the power from the processing unit 20 is stopped. Likewise, static data and the data in the intermediate format stored in the NVRAM 12 are also held due to nonvolatility of the NVRAM 12. Furthermore, the data storage section 11 is also a nonvolatile memory, and so the document data stored therein is also held.

Thus, the information carrier 10 can keep displaying the information even with no supply of power, that is, when the information carrier 10 is separated from the processing unit 20. Therefore, it can realize operability close to that of paper.

Furthermore, if the processing unit 20 that has been separated is connected to the information carrier 10 again, the CPU 22 checks the static data stored in the NVRAM 12 and continues a display process of the document data form a current display state in the case where it is determined to be valid data. As to whether or not the static data stored in the NVRAM 12 is valid, it can be determined by whether or not its data format is suited as a processing object of the processing unit 20 or by a check sum added in advance to the static data.

As the processing unit 20 is an operating instrument for the information carrier 10 according to this embodiment, where the user performs the operation such as turning the page, the operation of separating the processing unit 20 from the information carrier 10 and reconnecting it thereto is sequentially performed as described above. To be more specific, in the case where the user performs the operation, the processing unit 20 is connected to the information carrier 10 so as to input the instruction signal to turn the page via the instruction input section 15 or from an unshown instruction button provided to the processing unit 20.

Then, the inputted instruction signal is inputted to the CPU 22, and the CPU 22 performs the process according to the instruction.

As the processing unit 20 is an operating instrument for the information carrier 10 according to this embodiment, in the case where the user performs the operation such as turning the page, the operation of separating the processing unit 20 from the information carrier 10 and reconnecting it thereto is sequentially performed as described above. To be more specific, in the case where the user performs the operation, the processing unit 20 is connected to the information carrier 10 so as to input the instruction signal to turn the page via the instruction input section 15 or from an unshown instruction button provided to the processing unit 20.

Then, the inputted instruction signal is inputted to the CPU 22, and the CPU 22 performs the process according to the instruction.

Thus, the information related to the displayed document (document data, data in the intermediate format and static data) is stored on the information carrier 10, and thus no data that is inseparable from the connected information carrier 10 is left on the processing unit 20. Therefore, it is possible to arbitrarily change the connected information carrier 10 to something different.

As described above, the information display 1 according to this embodiment has the information carrier 10 including the storable display panel 14 separate from the processing unit 20 including the battery 27. In the case where there is a need to perform a process such as updating or manipulating the information displayed on the display panel 14, it is possible to perform the desired process by connecting the processing unit 20 to the information carrier 10.

For that reason, it is possible, in normal use, to separate components other than those for maintaining the "display" which is fundamentally required for a display close to "paper" from the information display 1.

Thus, it is possible to render a light-armed apparatus while combining good display quality close to "paper" with reusable information (the function of handling displayed information as electronic data) so as to significantly improve operability in comparison with a conventional information display.

Figure 4:
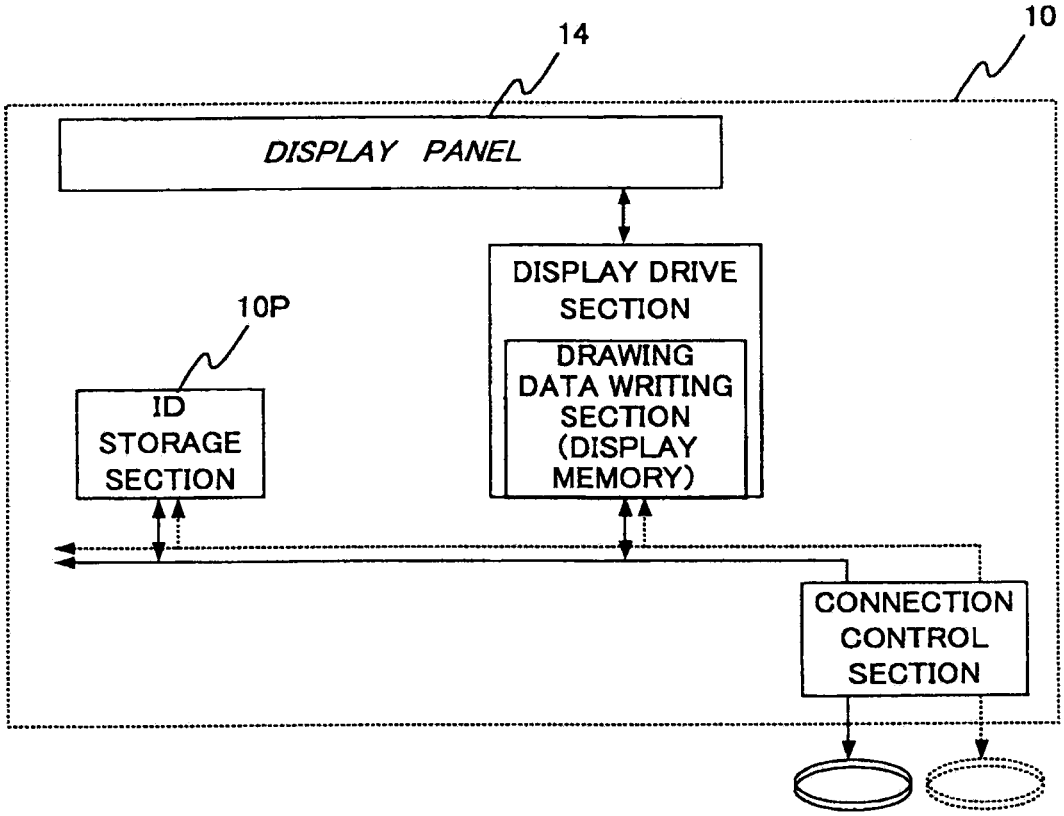
FIG. 4 is a diagram showing the configuration in which each information carrier has an ID storage section for identifying each individual information carrier.

It is also possible, by configuring the information carrier 10 of this embodiment as shown in FIG. 4, to handle multiple information carriers 10 while identifying each of them.

FIG. 4 shows the configuration in which each of the information carriers 10 includes an ID storage section 10P for identifying each of the information carriers 10.

In the case of such a configuration, it is feasible to have multiple information carriers 10 operated by one processing unit 20 while performing various kinds of management with an ID. To be more precise, even in the case where the data as a display object is stored in the processing unit 20 or in a server on a network, it can be associated with the information carriers 10. Therefore, it is possible to widen the applications of the information display 1.

The embodiment just described is an example in which the display panel 14 includes a storable display element. It is also feasible, however, to have a configuration in which a non-storable display element and a small power supply for maintaining the display state thereof are combined instead of the storable display element.

Figure 5:
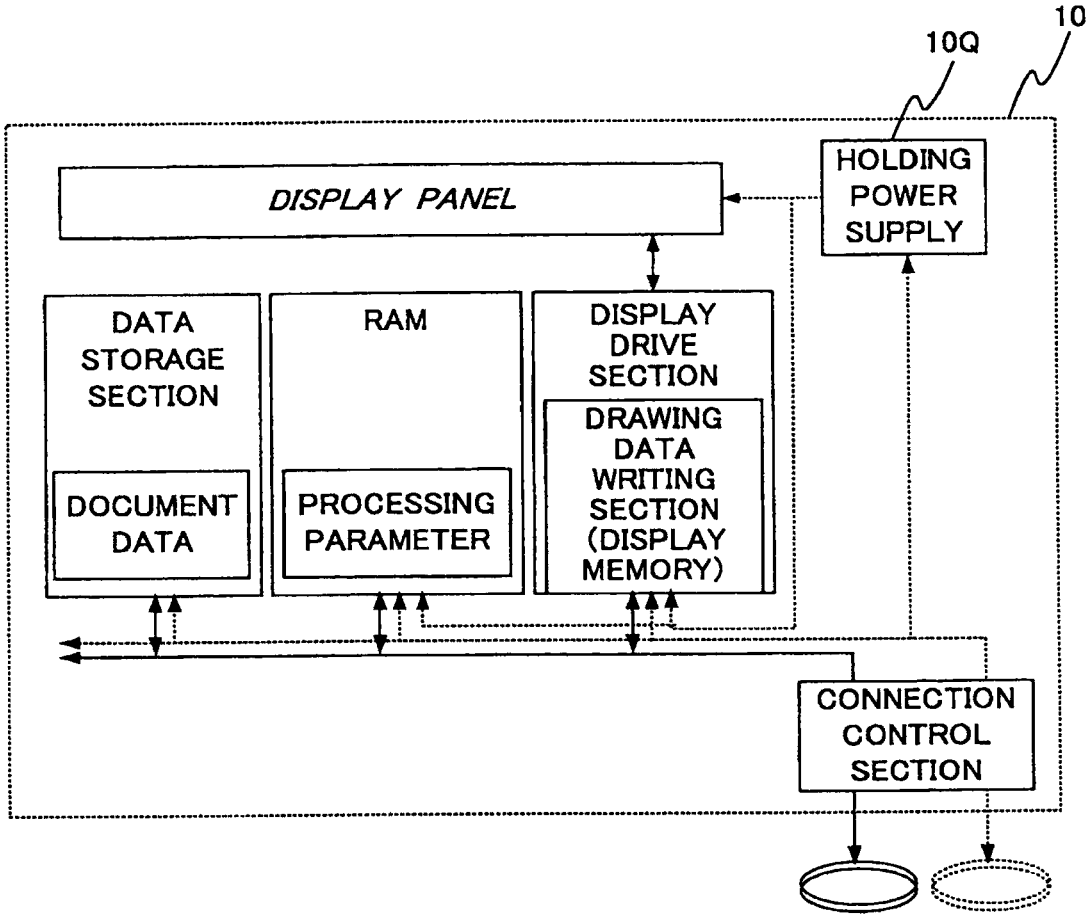
FIG. 5 is a diagram showing the information carrier having both a non-storable display element and a small power supply for maintaining a display state thereof instead of a storable display element.

FIG. 5 is a diagram showing the configuration of the information carrier 10 having both the non-storable display element and small power supply (holding power supply 10Q) for maintaining the display state thereof instead of the storable display element.

With such a configuration, it is possible, even in the case of using the non-storable display element, to substantially use it as the storable display element.

This embodiment also described the configuration in which the CPU 22, storage section 23 and GA 24 are provided to the processing unit 20. However, the components other than the battery 27 may be provided to either the processing unit 20 or the information carrier 10.

Furthermore, the embodiment just described includes the example of supplying the power from the processing unit 20 to the information carrier 10. It is also feasible, however, to have a configuration in which a power supply unit for supplying the power to the information carrier 10 is separate from the processing unit 20.

Figure 6:
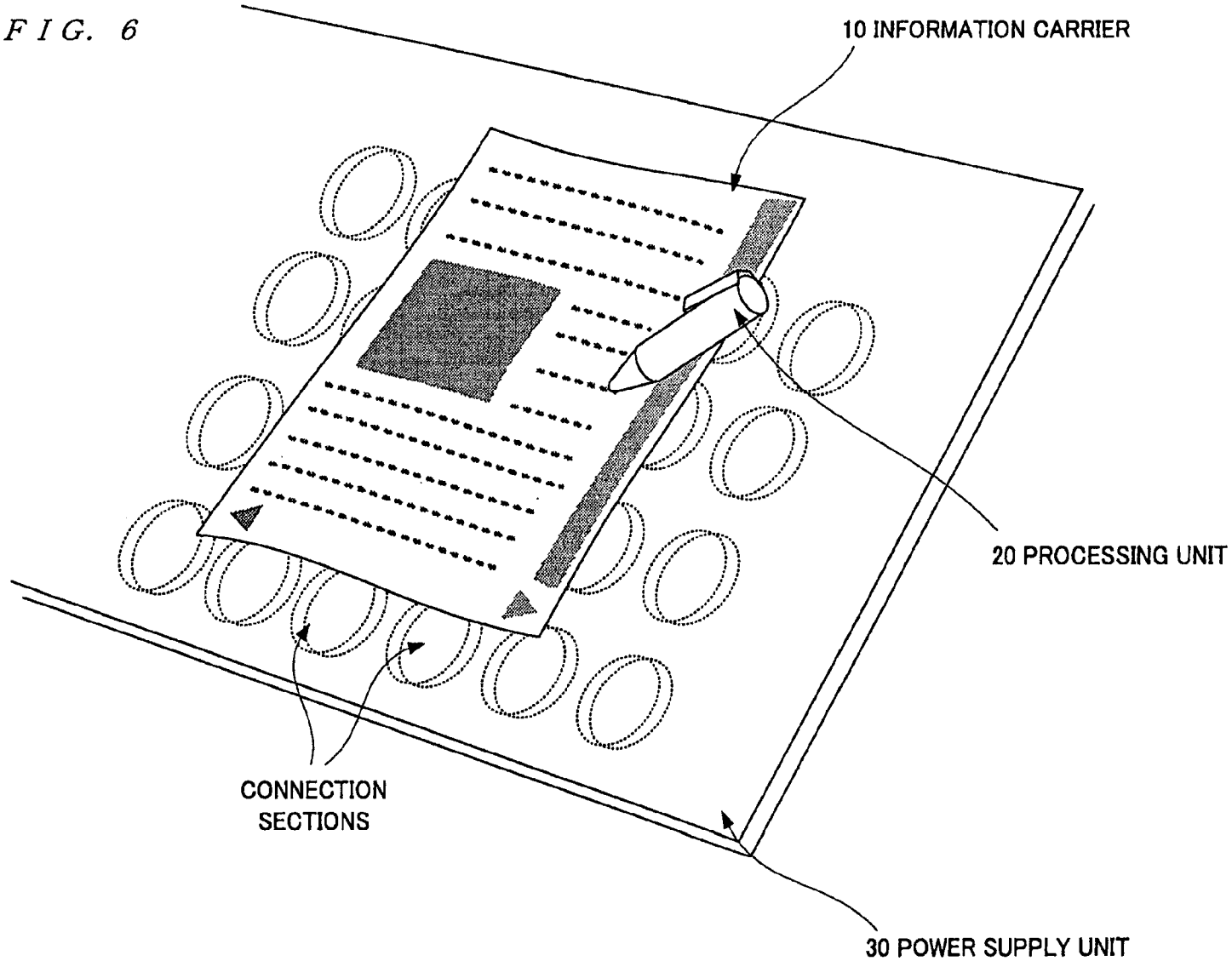
FIG. 6 is a diagram showing an example wherein the information display comprises three units of the information carrier, a processing unit and a power supply unit.

FIG. 6 is a diagram showing an example of configuring the information display 1 with the three units of the information carrier 10, processing unit 20 and a power supply unit 30.

In FIG. 6, the information carrier 10 has the connection section 17 provided on a backside thereof to be electromagnetically connectable to the coil on the power supply unit 30 side which is embedded in a desk mat or a desk surface.

In the case of rewriting the information displayed on the information carrier 10, the information is processed by the processing unit 20 while the power for rewriting is supplied from the power supply unit 30.

With such a configuration, it is possible, as a method of use, to arrange the multiple information carriers 10 on the desk surface and have them sequentially operated with one processing unit 20 by the user.

Second Embodiment

Next, a second embodiment of the present invention will be described.

Figure 7:
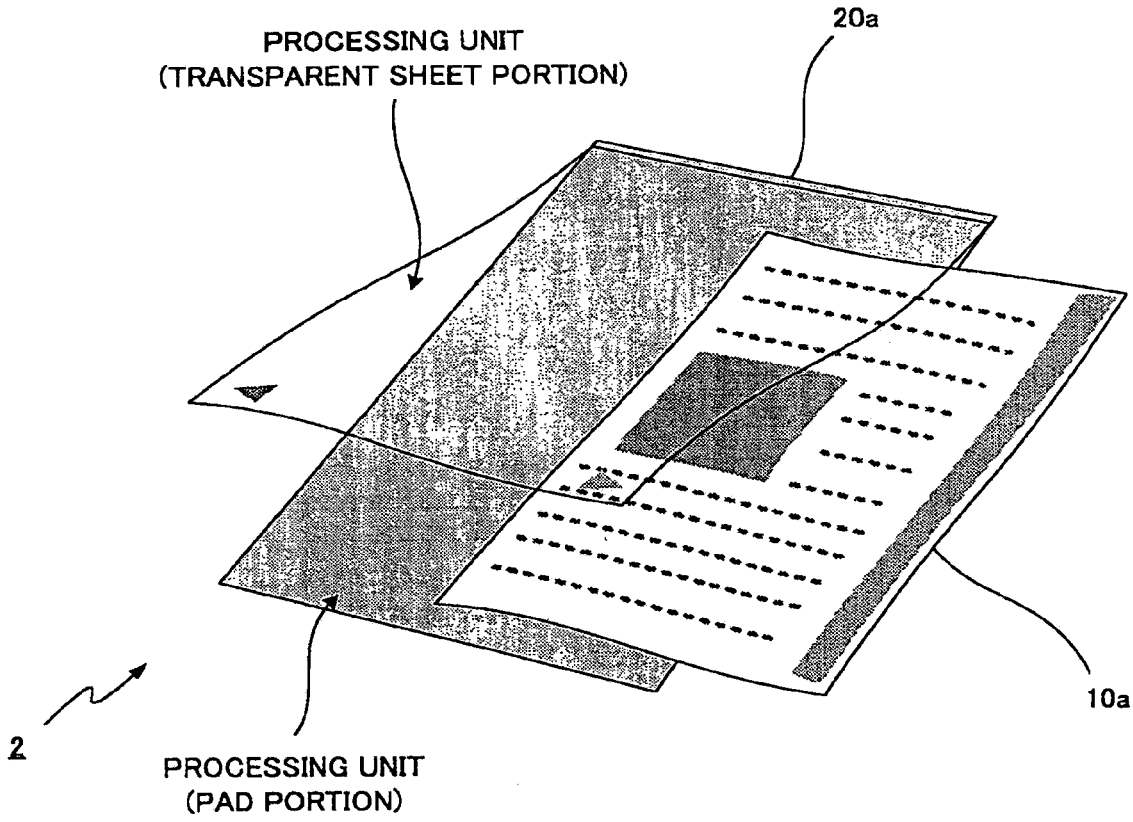
FIG. 7 is a diagram showing an external view of an information display according to a second embodiment.
Figure 8:
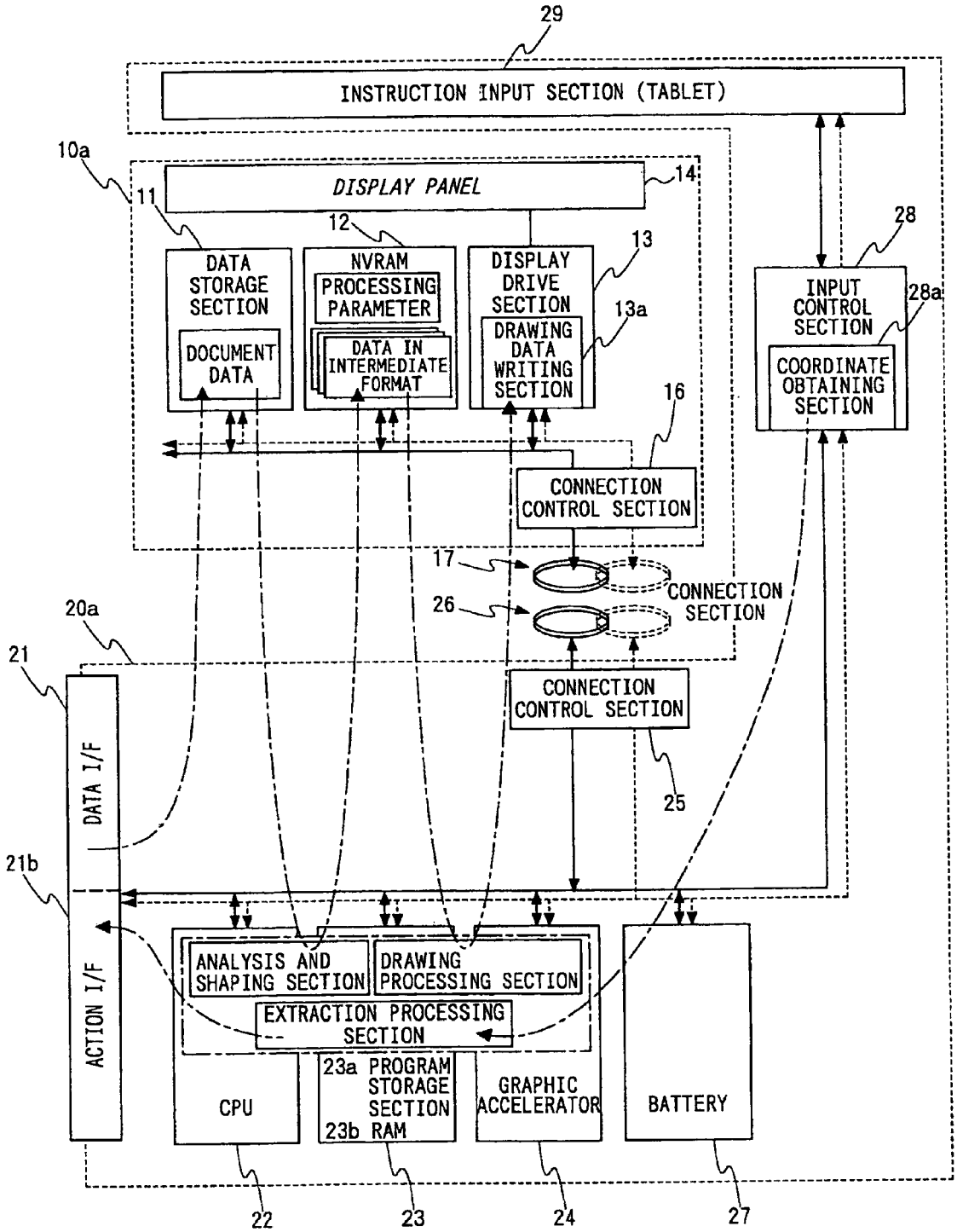
FIG. 8 is a diagram showing a functional configuration of the information display.

FIG. 7 is a diagram showing an external configuration of an information display 2 according to this embodiment, and FIG. 8 is a diagram showing a functional configuration of the information display 2.

In FIGS. 7 and 8, the information display 2 is comprised of an information carrier 10*a* and a processing unit 20*a*.

As shown in FIG. 8, the functional configuration of the information carrier 10*a* and processing unit 20*a* includes a portion in common with that of the information carrier 10 and a processing unit 20 of the first embodiment. Therefore, FIG. 2 should be referred to for illustrating the common portion while only a different portion will be described here.

The information carrier 10*a* has almost the same functional configuration as the information carrier 10 of the first embodiment except that the instruction input section 15 is not provided thereto. However, the information carrier 10*a* has the connection section 17 mounted at a location different from the information carrier 10 of the first embodiment.

To be more specific, the connection section 17 of the information carrier 10*a* is provided at each of the four corners of the backside of the information carrier 10*a* (the backside of the display screen). It is mounted in a positional relation corresponding to the connection section 26 provided on a pad of the processing unit 20*a* as will be described later.

As shown in FIG. 7, the processing unit 20*a* is configured in a form of a pad with a transparent sheet, where the information carrier 10*a* is sandwiched between the pad (a lower substrate) and the transparent sheet (upper sheet) and the processing unit 20*a* is thereby connected to the information carrier 10*a*.

The connection section 26 of the processing unit 20*a* is provided at each of the four corners of the top face of the pad. The four connection sections 26 are mounted to be opposed to the four connection sections 17 of the information carrier 10*a* in the case where the information carrier 10*a* is sandwiched between the pad and the transparent sheet.

Furthermore, the processing unit 20*a* is comprised of an action interface (hereafter, referred to as an "action I/F") 21*b*, an input control section 28 and an instruction input section 29.

The action I/F 21*b* is the interface for conveying the information to other apparatuses such as the communication interface, and is capable of, by performing input operation to the instruction input section 29, sending the data such as a character string selected by the user to another apparatus such as a PC or a printer or another information display 1 via the action I/F 21*b*.

The input control section 28 has a function of the interface for controlling a signal input from the instruction input section 29, and receives an input signal generated by the instruction input section 29 so as to output a processing result to the sections such as the CPU 22 after performing a predetermined process. For instance, the input control section 28 has a coordinate obtaining section 28*a* for calculating a coordinate of a contact position in the case where the user contacts an input surface of the instruction input section 29 so as to output the calculated coordinate of the contact position to the sections such as the CPU 22.

The instruction input section 29 is comprised of the transparent sheet having a function of a touch tablet, and has an input surface capable of receiving the instruction input to the information display 2 from the user. The input surface of the instruction input section 29 is configured to have almost the same size as a display surface of the display panel 14. In the case where the instruction input section 29 overlaps the display surface of the display panel 14, the coordinate on the input surface of the instruction input section 29 and the coordinate on the display surface of the display panel 14 are associated with each other.

To be more specific, when getting sandwiched between the pad and the transparent sheet of the processing unit 20*a*, the information carrier 10*a* has the four connection sections 17 positioned to be approximately opposed to the four connection sections 26 mounted on the top face of the pad respectively.

The coordinates are set on the transparent sheet with reference to the positions of the connection sections 26 so that the coordinate of the contact position is identified if the user contacts the transparent sheet. As it is difficult to exactly position the transparent sheet and the information carrier 10*a*, it is also possible to correct a positioning state of the transparent sheet and the information carrier 10*a* based on a balance of signal power of each of the combinations of the four connection sections 17 and 26.

The coordinates in common with those on the transparent sheet are set on the display surface of the display panel 14 of the information carrier 10*a* with reference to the positions of the connection sections 17 so that the corresponding position on the display surface of the display panel 14 is identified if the user contacts the transparent sheet and the coordinate of the contact position is identified.

Therefore, in the case where the user contacts the input surface of the instruction input section 29 (transparent sheet) in order to select the information displayed on the display panel 14, the CPU 22 can grasp the information on the display panel 14 corresponding to the contact position.

It is possible, under the above-mentioned configuration, to realize the analysis and shaping section 110, drawing processing section 120 and an extraction processing section 130 shown in FIG. 8 by having the predetermined program executed by the information display 2.

The analysis and shaping section 110 and drawing processing section 120 are the same as those in the first embodiment, and so a description thereof will be omitted.

The extraction processing section 130 identifies the information displayed on the display panel 14 based on the position on the input surface of the instruction input section 29 contacted by the user. The extraction processing section 130 can also send an element of document data (text or an image) corresponding to the identified information to another apparatus via the action I/F 21*b* or copy and paste it.

Next, an operation of the above will be described.

As for the information display 2, the process until the document is displayed on the display panel 14 is the same as that of the information display 1.

If the user selects information such as the character string displayed on the display panel 14 via the instruction input section 29, the extraction processing section 130 identifies the element such as the text or image of the document data as to the selected information.

Furthermore, the extraction processing section 130 obtains the identified element from the data storage section 11.

Consequently, the information display 2 can send the information as the object of the input operation performed by the user (user action) to another apparatus via the action I/F 21*b* or copy and paste it on another portion of the display panel 14.

As described above, the information display 2 according to this embodiment has the information displayed on the display panel 14 associated with the element of the document data. If the user performs the input operation to the information displayed on the display panel 14, the element of the document data corresponding thereto is obtained.

Therefore, it is possible to utilize the information displayed on the display panel 14 as the electronic data.

Third Embodiment

Next, a third embodiment of the present invention will be described.

Figure 9:
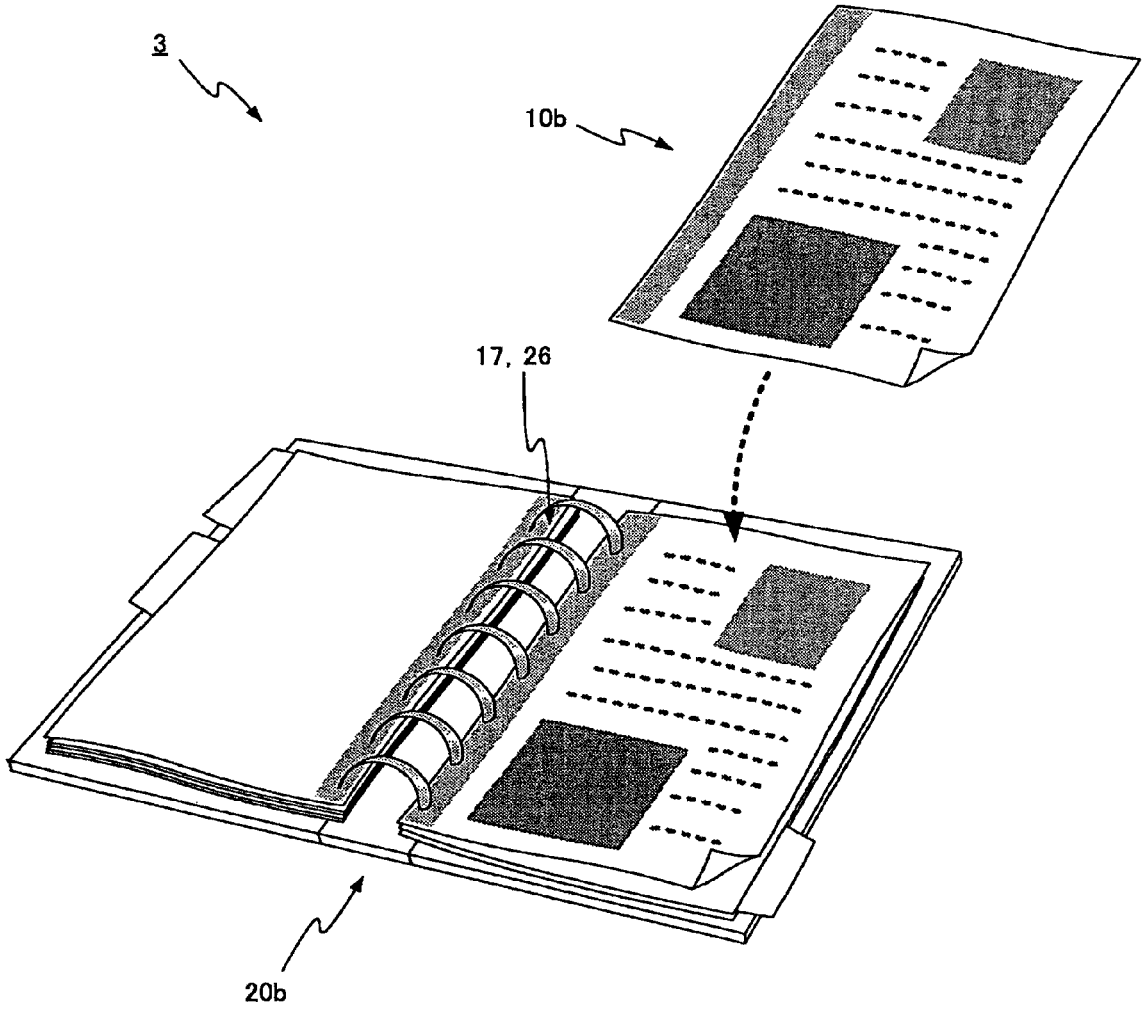
FIG. 9 is a diagram showing an external view of an information display according to a third embodiment.

FIG. 9 is a diagram showing an external configuration of an information display 3 according to this embodiment.

In FIG. 9, the information display 3 is comprised of an information carrier 10*b* and a processing unit 20*b*.

The information carrier 10*b* has the same configuration as the information carrier 10*a* of the second embodiment except the connection section 17.

The information carrier 10*b* has staple holes to be penetrated by ring-shaped staples for binding the information carrier 10*b* with the processing unit 20*b*, where the connection sections 17 are comprised of the staples and staple holes penetrated by the staples.

To be more specific, the staples and staple holes configure electrical contacts or the electromagnetic interface via which the information carrier 10*b* and processing unit 20*b* send and receive the information.

The processing unit 20*b* has the external configuration of a binder form. The processing unit 20*b* also has the ring-shaped staples, and is capable of binding the information carrier 10*b* in a form of binding a binder leaf. Furthermore, the processing unit 20*b* can bind multiple information carriers 10*b* with the staples and can also send and receive the information by identifying the information carriers 10*b* via the staples as the connection sections 17.

To be more precise, a seven-digit identification code is assigned to each of the information carriers 10*b*. When inputting and outputting the information, a code of "0" or "1" is outputted to each of the seven ring portions in FIG. 9 so as to identify the seven-digit identification code. Then, the information carriers 10*b* are uniquely identified, and it becomes possible to have the information inputted and outputted between a specific information carrier 10*b* and the processing unit 20*b*.

It is also possible to secure a part of the seven ring portions for supplying the power.

Next, the operation of the above will be described.

As for the information display 3, the process until the information is displayed on each information carrier 10*b* is the same as that of the information display 1.

The information display 3 has a piece of the data stored on each information carrier 10*b*, and has multiple information carriers 10*b*, that is, multiple pieces of the data stored in the processing unit 20*b*. Thus, the information display 3 has a function of a card-type database.

In the case of browsing or transferring the information, it is possible to remove the information carriers 10*b* from the processing unit 20*b* with the information displayed and the document data stored as-is.

Therefore, it is possible to browse the information carrier 10*b* storing a specific piece of the information by separating it from the processing unit 20*b* and also use the document data stored on the information carrier 10*b* in another processing unit 20*b*.

In the above-mentioned configuration, it is also possible for the processing unit 20*b* to extract and calculate the data of a predetermined field on the information carrier 10*b*, update the calculated data of the information carrier 10*b* and perform the same process collectively to the multiple information carriers 10*b* which are bound.

As described above, the information display 3 according to this embodiment can conveniently handle the information stored in the information carrier 10*b* like a leaf bound by a binder.

Therefore, it is possible to handle the information which is an incorporeal thing as a corporeal thing so as to construct an intuitively understandable database.

It is also possible to have the information stored in the information carrier 10*b* handled as the electronic data by the processing unit 20*b* so as to easily process the information stored in the information carrier 10*b*.

Thus, according to the present invention, it is possible to secure a high degree of freedom in the configuration of the information displays 1 to 3 and render the portion including the display panel 14 lightweight so as to render the operability of the portion including the display panel 14 closer to that of paper.

To be more specific, according to the present invention, it is possible to realize an information display having the convenience capable of replacing paper.

To be more precise, it is possible to realize the information display capable of handling the information in a free usage pattern as with paper and in a reassuring form as with paper at relatively low cost.

The invention claimed is:

1. An information display system comprising:

an information display unit which includes a memorable display;

a processing unit, which instructs rewriting of display contents to the information display unit, which is separately provided from the information display unit, and which is capable of supplying power to the information display unit by electromagnetic connection to the information display unit; and a power supply unit which supplies is adapted to supply the power to the information display unit and inputs instruction information from the processing unit, wherein the information display unit includes a storage section for nonvolatilly holding intermediate format data and static data that is data representing a state of processing including a page number currently in process obtainable during generation of display data from document data, the intermediate format data being generated by performing a layout process on the document data to be broken down into draw elements, wherein the processing unit comprises an analysis and shaping section and a drawing processing section, wherein the analysis and shaping section performs the layout process on the document data for screen display and stores the processed document data in the storage section of the information display unit, as the intermediate format data, and the drawing processing section rasterizes the draw elements included in the intermediate format data stored in the storage section of the information display unit to display draw data on the information display unit, wherein the document data, the intermediate data, and the static data are not stored in the processing unit, wherein the document data, the intermediate data, and the static data are stored in the information display unit, and wherein when the processing unit is re-connected to the information display unit after the processing unit is separated from the information display unit and the supply of the power from the processing unit is stopped, the processing unit checks the static data stored in the storage section and continues a display process of the document data from a time when the supply of the power is stopped.

2. The information display system according to claim 1, wherein while rewriting the display contents of the information display unit, the power is supplied from the power supply unit to the information display unit.

3. The information display system according to claim 2, wherein the information display unit has a first connection section, the power supply unit has a second connection section, and the first connection section and the second connection section are electromagnetically connectable each other.

4. The information display system according to claim 3, wherein the first connection section has a first coil that inputs and outputs the instruction information and a second coil that inputs the power, the second connection section has a third coil that inputs and outputs the instruction information and a fourth coil that outputs the power, and the first coil and the third coil are electromagnetically connectable each other and the second coil and the fourth coil are electromagnetically connectable each other.

5. The information display system according to claim 1, wherein the processing unit is a pen-shaped operating instrument.

6. The information display system according to claim 3, wherein the power supply unit has multiple second connection sections for connecting to multiple information display units.

* * * * *